US006193109B1

(12) United States Patent
Credle, Jr. et al.

(10) Patent No.: US 6,193,109 B1
(45) Date of Patent: Feb. 27, 2001

(54) PUMP FOR CONCENTRATION PACKAGES

(75) Inventors: William S. Credle, Jr., Roswell, GA (US); Alfred A. Schroeder, San Antonio, TX (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/432,329

(22) Filed: Nov. 2, 1999

(51) Int. Cl.[7] ..... B67D 5/00

(52) U.S. Cl. ..... 222/129.4; 222/129.1; 222/135; 222/145.5

(58) Field of Search ..... 222/129.1–129.4, 222/135–137, 145.1, 145.5, 145.6, 386, 387

(56) References Cited

U.S. PATENT DOCUMENTS

| | | | | |
|---|---|---|---|---|
| 665,145 | | 1/1901 | Stumpf . | |
| 1,196,920 | | 9/1916 | Astrom . | |
| 2,778,534 | * | 1/1957 | Ramsey | 222/129.4 |
| 3,134,508 | * | 5/1964 | Bayer et al. | 222/135 |
| 3,327,614 | * | 6/1967 | Bridges et al. | 222/129.1 |
| 3,816,029 | | 6/1974 | Bowen et al. . | |
| 3,830,405 | * | 8/1974 | Jaeger | 222/129.3 |
| 4,018,545 | | 4/1977 | Knedlik . | |
| 4,479,758 | * | 10/1984 | Hersom et al. | 222/129.2 |
| 4,807,783 | * | 2/1989 | Van Zijverden | 222/129.2 |
| 4,953,754 | * | 9/1990 | Credle, Jr. | 222/129.2 |
| 4,967,936 | * | 11/1990 | Bingler | 222/129.2 |
| 5,243,897 | | 9/1993 | Walton et al. . | |
| 5,348,192 | | 9/1994 | Sardynski et al. . | |
| 5,348,454 | | 9/1994 | Murphy . | |
| 5,381,926 | | 1/1995 | Credle, Jr. et al. . | |
| 5,476,193 | * | 12/1995 | Haynes | 222/129.2 |
| 5,524,791 | * | 6/1996 | Credfle, Jr. et al. | 222/129.1 |
| 5,603,432 | | 2/1997 | Sardynski et al. . | |
| 5,676,277 | | 10/1997 | Ophardt . | |
| 5,688,113 | | 11/1997 | Bareiss et al. . | |
| 5,725,125 | * | 3/1998 | Bessette et al. | 222/129.1 |

* cited by examiner

*Primary Examiner*—J. Casimer Jacyna
(74) *Attorney, Agent, or Firm*—Sutherland Asbill & Brennan LLP

(57) ABSTRACT

A postmix beverage dispenser which includes pair of one-way valves to provide more continuous flow of concentrate into a metered water flow. The configuration according to the present invention has the cost advantages of a single-acting pump and the smooth-flow advantages of a double-acting pump. The single-acting reciprocating pump has a flow pattern that is similar to double-acting reciprocating pumps. The pump readily folds up into the package to facilitate shipping and can be constructed of rigid plastic materials to make for easier loading and unloading the package into the dispenser. The pump can be constructed primarily from inexpensive commodity plastics.

20 Claims, 5 Drawing Sheets

PUMP FOR CONCENTRATION PACKAGES

TECHNICAL FIELD

The present invention relates generally to liquid pumping, and particularly relates to a concentrate pump/nozzle for use in dispensing beverages such as juices.

BACKGROUND OF THE INVENTION

Postmix juice dispensers that feature disposable, front-load concentrate packages are currently the most user-friendly dispensers. If the front-load package includes an integral pump/nozzle, the amount of routine sanitizing required by storeowners is minimized. The prior art includes front-load packages with integral pump/nozzles. However, such configurations have several problems:

1) the pump must be constructed of expensive flexible materials.
2) the pulsation of the pump is objectionable to customers and consumers.
3) all mixing must take place in the nozzle.
4) the pulsation makes mixing the concentrate with water difficult.

My U.S. Pat. No. 5,524,791, entitled "Low Cost Beverage Dispenser" discloses a low cost, manually operated, postmix juice dispenser including a water tank manually filled with water and ice, a removable concentrate container, and a water pump and a concentrate pump connected to a manually operated pump handle.

U.S. Pat. No. 5,494,193, entitled "Postmix Beverage Dispensing System" discloses a postmix juice dispensing system for dispensing a finished beverage directly from a pliable beverage concentrate having an ice point at or near freezer temperatures, with little or no conditioning. The system preferably uses a one-piece, unitary, disposable package that includes both the concentrate container and a positive displacement metering pump. The disposable package is placed in the dispenser which automatically connects the pump to a pump motor. A mixing nozzle is connected to the metering pump and a water line is connected to the mixing nozzle. Upon pushing a load button, the dispenser automatically feeds compressed air on top of a piston in the concentrate container to force concentrate into the pump. The dispenser automatically reads an indicator on the package to set the pump speed in response to the type of concentrate in the package. The dispenser requires no cleanup or sanitization and allows rapid flavor change.

U.S. Pat. No. 5,797,519, entitled "Postmix Beverage Dispenser", discloses a postmix beverage dispenser including a housing, a water bath, a refrigeration system, a concentrate package compartment, a cooling system for the compartment, and a potable water circuit including a cooling coil in the water bath. The concentrate packages are preferably bag-in-box packages with a flexible tube, and the dispenser includes a peristaltic pump driven by a gearhead motor with an encoder. A flow meter in the potable water line feeds information to the control system which controls the pump speed to control ratio. A ratio card is inserted into a slot in the door to tell the control system the ratio to use for each BIB package. A removable water nozzle improves mixing. An improved subassembly and method for making it is described. The potable water cooling coil is above the evaporator coil and separately removable from the water bath.

U.S. Pat. No. 4,860,923, entitled "Postmix Juice Dispensing System", discloses a postmix juice dispensing system for reconstituting and dispensing pliable 5+1 orange juice at freezer temperatures of from about −10° F. to 0° F., including a pressurizable canister for pressurizing concentrate in a flexible bag and for forcing the concentrate through a concentrate conduit into a heat exchanger, then into a metering device and then into a mixing chamber where the concentrate mixes with water fed also through a metering device. The dispensing system includes a remote, under-the-counter refrigeration system with a recirculating water chiller for chilling the concentrate reservoir in the dispenser, a water tank, a pressurizable concentrate canister in the tank, and a potable water heat exchange coil in a cold water bath to cool the potable water to be used in the dispenser.

U.S. Pat. No. 4,901,886, entitled "Bag-in-tank Concentrate System for Postmix Juice Dispenser", discloses a postmix juice dispensing system for reconstituting and dispensing pliable orange juice at freezer temperatures including a pressurizable canister for pressurizing concentrate in a flexible bag and for forcing the concentrate out of the bag. The canister includes a slidable carrier therein for receiving the bag and locking the bag outlet fitting in a proper location to matingly connect to the canister inlet fitting.

Although the above configurations include advantages, improvements are always welcomed. Therefore it may be seen that there is a need in the art for an improved postmix juice dispenser.

SUMMARY OF THE INVENTION

The present invention overcomes deficiencies in the art by providing a pump which provides an improved postmix product dispenser.

Generally described, the present invention is directed towards a pump and dispenser apparatus for mixing a first and a second fluid, the apparatus comprising a body, the body defining a first fluid inlet port, a second fluid inlet port, a mixed fluid outlet port, and an interior chamber configured for at least partial mixing of the first and second fluids, a pump member configured for movement relative to the body, the movement being oscillating linear motion alternating between a first linear direction and a second linear direction, the pump member including a pumping portion configured for the oscillating linear motion at least partially within the interior chamber of the body, a first one-way valve within the body, the first valve configured to allow fluid flow from the first fluid inlet port to the interior chamber of the body, a second one-way valve within the pump member, the second valve configured to allow mixing of the first and second fluids within the interior chamber, such that movement of the pump member in the first direction tends to cause flow though the first valve from the inlet port to the interior chamber, and movement of the pump member in the second direction tends to cause mixing of the first and second fluids within the interior chamber.

Therefore it is an object of the present invention to provide an improved postmix product.

It is a further object of the present invention to provide an improved postmix product dispenser.

It is a further object of the present invention to provide an improved postmix product dispenser which is simple to operate.

It is a further object of the present invention to provide an improved postmix product dispenser which is simple to sanitize.

It is a further object of the present invention to provide an improved postmix product dispenser which is reliable in operation.

It is a further object of the present invention to provide an improved postmix product dispenser which is low in cost to allow for disposable operation.

It is a further object of the present invention to provide an improved postmix product dispenser which reduces pulsating outflow of product.

It is a further object of the present invention to provide an improved postmix product dispenser which provides suitable mixing of product.

It is a further object of the present invention to provide an improved postmix product dispensing module which can be easily shipped.

It is a further object of the present invention to provide an improved postmix product dispensing module which can be easily loaded into a dispenser.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 4 shows a general control configuration 100 including a controller 101 which controls a metering water pump/metering device 102 and a plunger oscillation drive 103. The controller is configured to control the relative speeds of elements 102 and 103.

DETAILED DESCRIPTION OF THE PREFERRED EMBODIMENT

Figure 1:
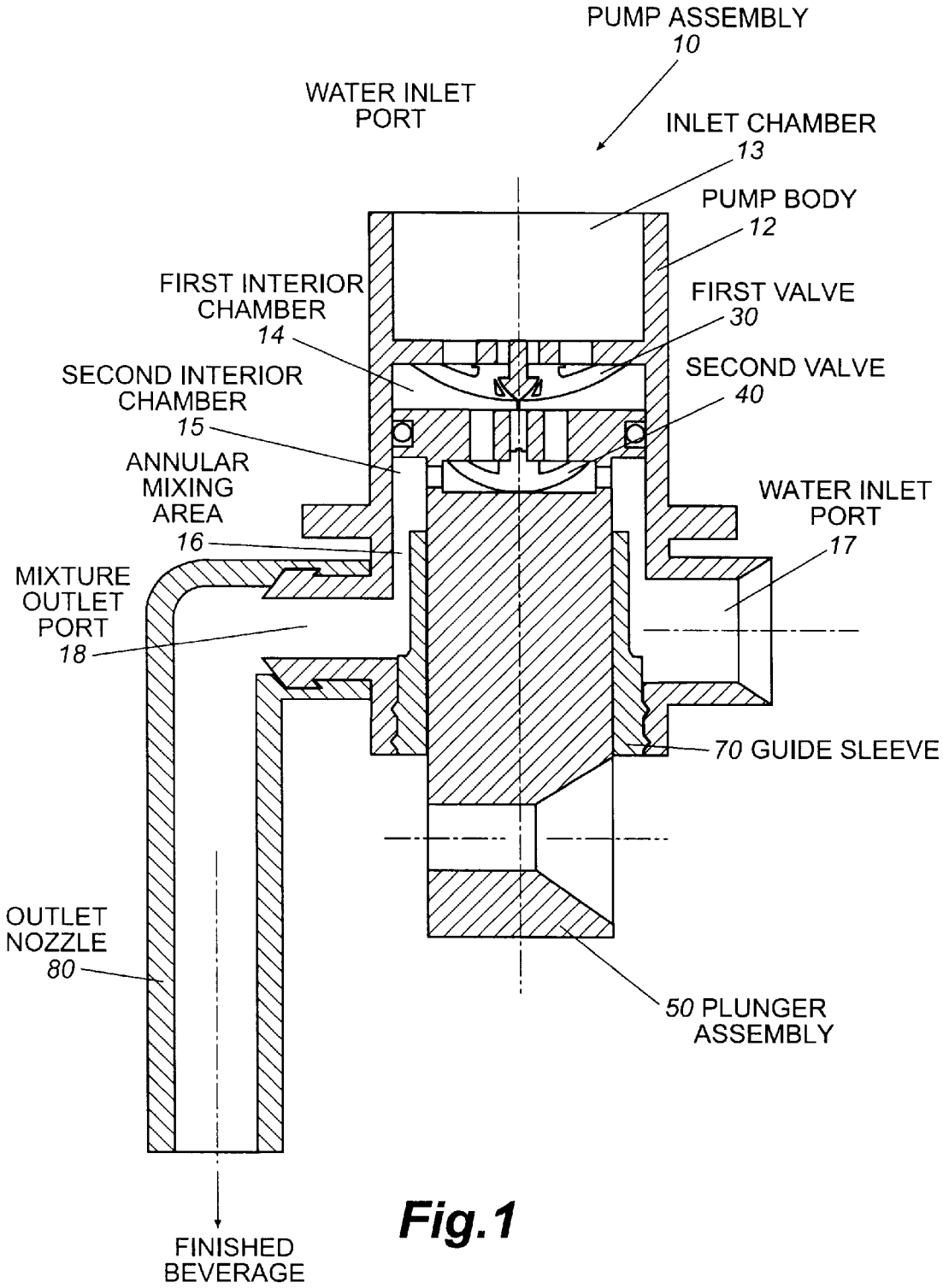
FIG. 1 shows a cross-section of the pump/valve assembly 10 according to the present invention.

Reference is now made to the figures, in which like numerals indicate like elements throughout the several views.

General Construction and Operation

The pump/valve assembly 10 (hereinafter the pump assembly 10) shown in FIG. 1 includes the following elements:

Pump body 12

First Valve 30

Second Valve 40

Plunger Assembly 50

Plunger Guide Sleeve 70

Outlet Nozzle 80

The Pump Body

The pump body 12 at least partially defines an upwardly-directed concentrate inlet chamber 13, a first chamber portion 14 and a second chamber portion 15 (which includes a annular mixing chamber 16. The body 12 also includes a water inlet port 17 and a mixture outlet port 18. The first and second chamber portions comprise a larger, generally cylindrically shaped, interior chamber.

The Plunger Assembly

Figure 5:
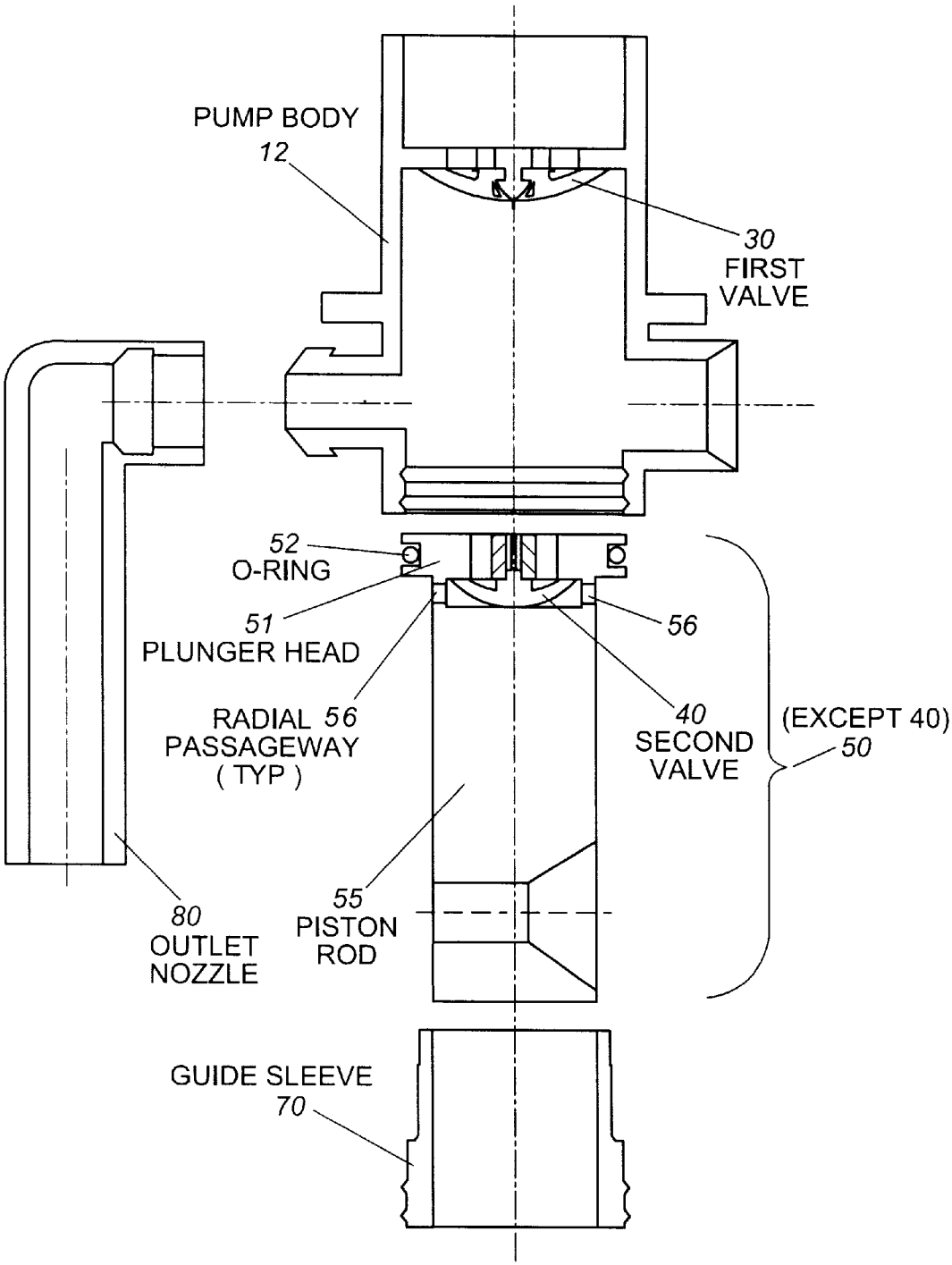
FIG. 5 is an exploded view of the configuration shown in FIG. 1. Mixture "M" flows out.

Referencing FIG. 5, the plunger assembly 50 includes a pumping plunger head 51 including an annular slot which accepts an O-ring 52 for sealing. The plunger assembly 50 also includes a cylindrically shaped piston rod 55. The plunger assembly 50 also defines various interior cavities and passageways which accept the second valve 40 and allow for fluid flow in one direction downwardly through the upwardly-directed face of the plunger head 51, through the second valve 40 and out through radial passageways 56 which empty into the second interior chamber 15 of the pump body 12.

The Guide Sleeve

The guide sleeve 70 is configured to slidably accept the cylindrically shaped piston rod 55 of the plunger assembly 50, to allow for the reciprocating up-and-down linear movement of the head 51 of the plunger assembly 50 within the interior chamber as discussed elsewhere in this discussion. The guide sleeve also seals around the piston rod 55 to prevent leakage.

The Outlet Nozzle

Figure 2:
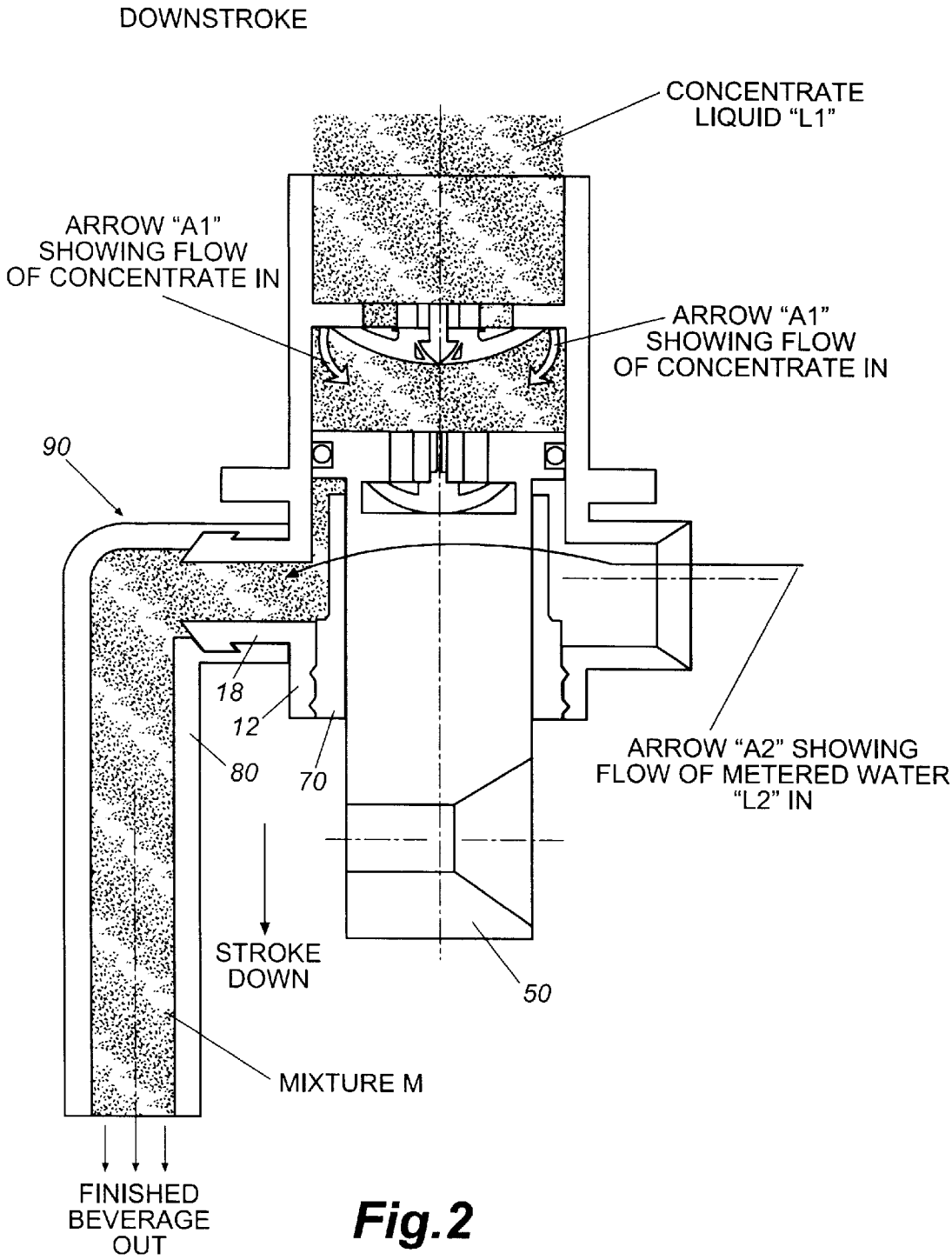
FIG. 2 shows the pump/valve assembly 10 of FIG. 1 with the plunger assembly 50 completing its "down" stroke. Arrows A1 illustrate flow of the "first" liquid L1 (the concentrate). Arrow A2 illustrates flow of the "second" liquid L2 (the water).

As shown in FIG. 2, a rotating connection is provided at 90 between the outlet nozzle 80 the mixture outlet port 18 of the pump body 12, to allow for relative rotation of the two elements 12, 80 from a storage position to a dispensing position. In one embodiment, these two positions are 180 degrees apart.

The Valves

The first and second valves 30, 40, are in one embodiment known as "umbrella valves", and are composed of a suitable elastomer or TPE. The first valve 30 is configured to provide one-way flow between the inlet chamber 13 and the first interior chamber 14. The second valve 40 is configured to provide one-way flow between the first interior chamber 14 and the second interior chamber 15.

Oscillation Drive Means

The plunger oscillation drive 102 (See FIG. 4) can be as known in the art, such as the use of a rotating drive fork which accepts a pin attached to the plunger assembly 50.

Operation

Figure 3:
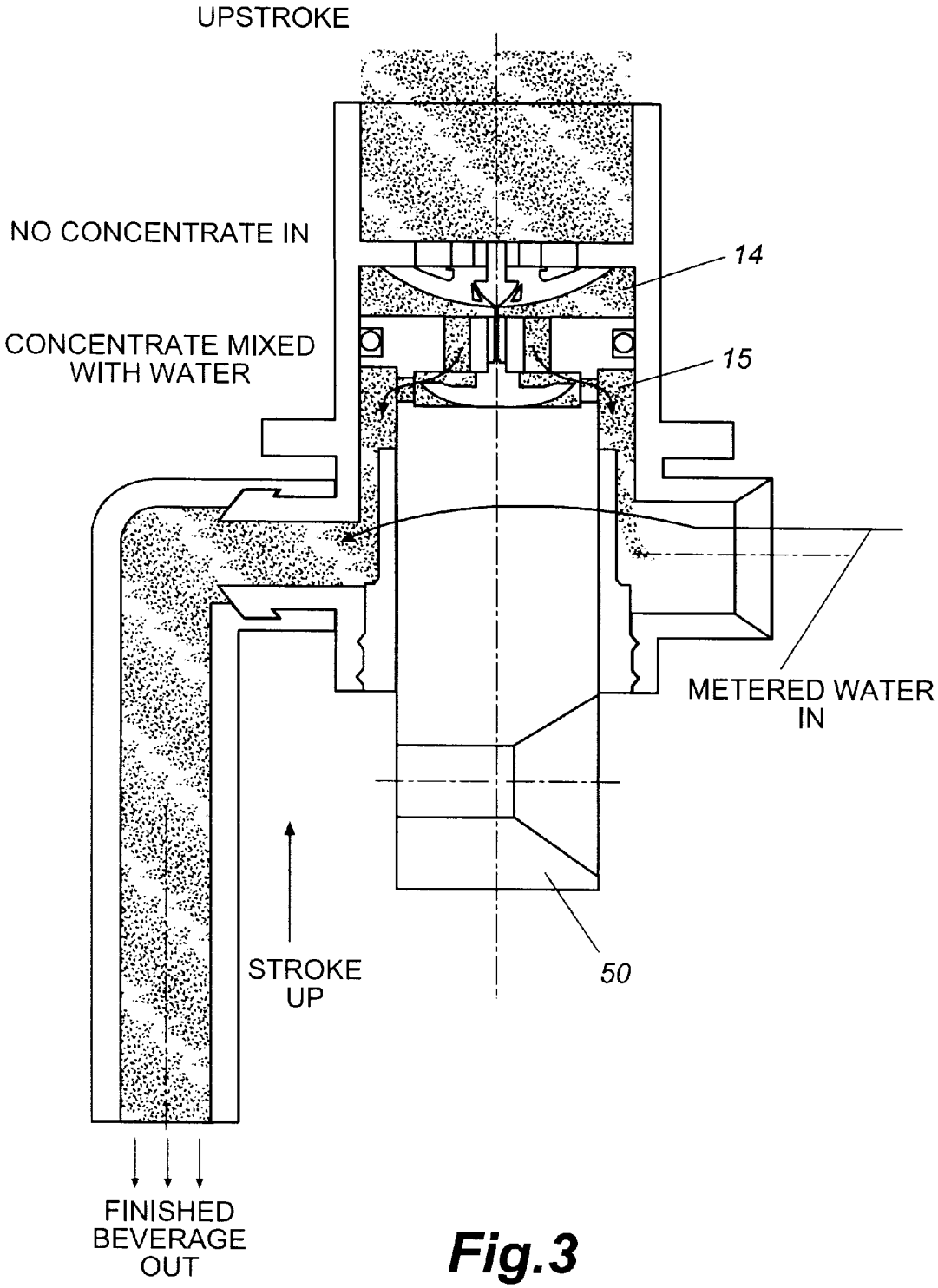
FIG. 3 shows the pump/valve assembly 10 of FIG. 1 with the plunger assembly 50 completing its "up" stroke.

Operation of the valve assembly is discussed in reference to FIGS. 2 and 3. FIG. 2 shows the pump/valve assembly 10 of FIG. 1 completing its "down" stroke. FIG. 3 shows the pump/valve assembly 10 of FIG. 1 completing its "up" stroke.

Referring now primarily to FIG. 2, but also to FIG. 1, it can be seen that as the plunger assembly 50 moves down to the bottom of its stroke, the first interior chamber 14 expands and concentrate (a.k.a. a "first" fluid) flows from the inlet chamber 13 to the first interior chamber 14. Throughout the down stroke of the plunger assembly 50, the first valve 30 is open and the second valve 40 is closed. FIG. 2 shows the plunger assembly 50 at the bottom of its stroke.

When the plunger assembly 50 reverses its direction and moves up towards the position shown in FIG. 3, concentrate moves from the first interior chamber 14 to the expanding second interior chamber 15 through the second valve 40. Throughout the up stroke of the plunger assembly 50 the first valve 30 is closed and the second valve 40 is open. FIG. 3 shows the plunger assembly 50 at the top of its stroke, with the first interior chamber 14 at its smallest and the second interior chamber 15 at its largest.

The second interior chamber 15 includes the annular mixing chamber 16, through which metered water (a.k.a. the "second" fluid) flows from the water inlet port 17.

It may be understood that the amount being pumped out the outlet port 18 during the upward stroke is only the amount displaced by the piston rod. Some concentrate (the piston area minus the rod area times the stroke) is not pumped out the outlet nozzle until the plunger assembly 50 moves down. Concentrate is thus pumped out the outlet port 18 on both the up and down strokes, resulting in smooth flow. Preferably, these two displacement volumes should be the same. This can be done by making the rod area half of the piston area.

A plunger oscillation drive 102 moves the piston up and down at a rate of approximately five cycles per second. While the plunger assembly 50 is moving up and down, water pumped by a metering water pump 101 continuously flows into the water inlet port 17 around annular chamber 16, and then out the outlet port 18 to the outlet nozzle 80 where it is dispensed. The rate at which the water flows into the water inlet determines the rate at which the piston is driven up and down.

An alternative configuration includes the use of only a water flow measuring device as item 102 (no metering pump) to measure water flow into the inlet port 17. The speed of the plunger oscillation drive 103 can then be matched to the water flow rate to provide a desired concentrate mix. Such a configuration would allow use of on-site water pressure to supply water to the valve. Should water pressure vary, The speed of the plunger oscillation drive 103 (a.k.a. "pump speed") can then similarly be varied.

Figure 4:
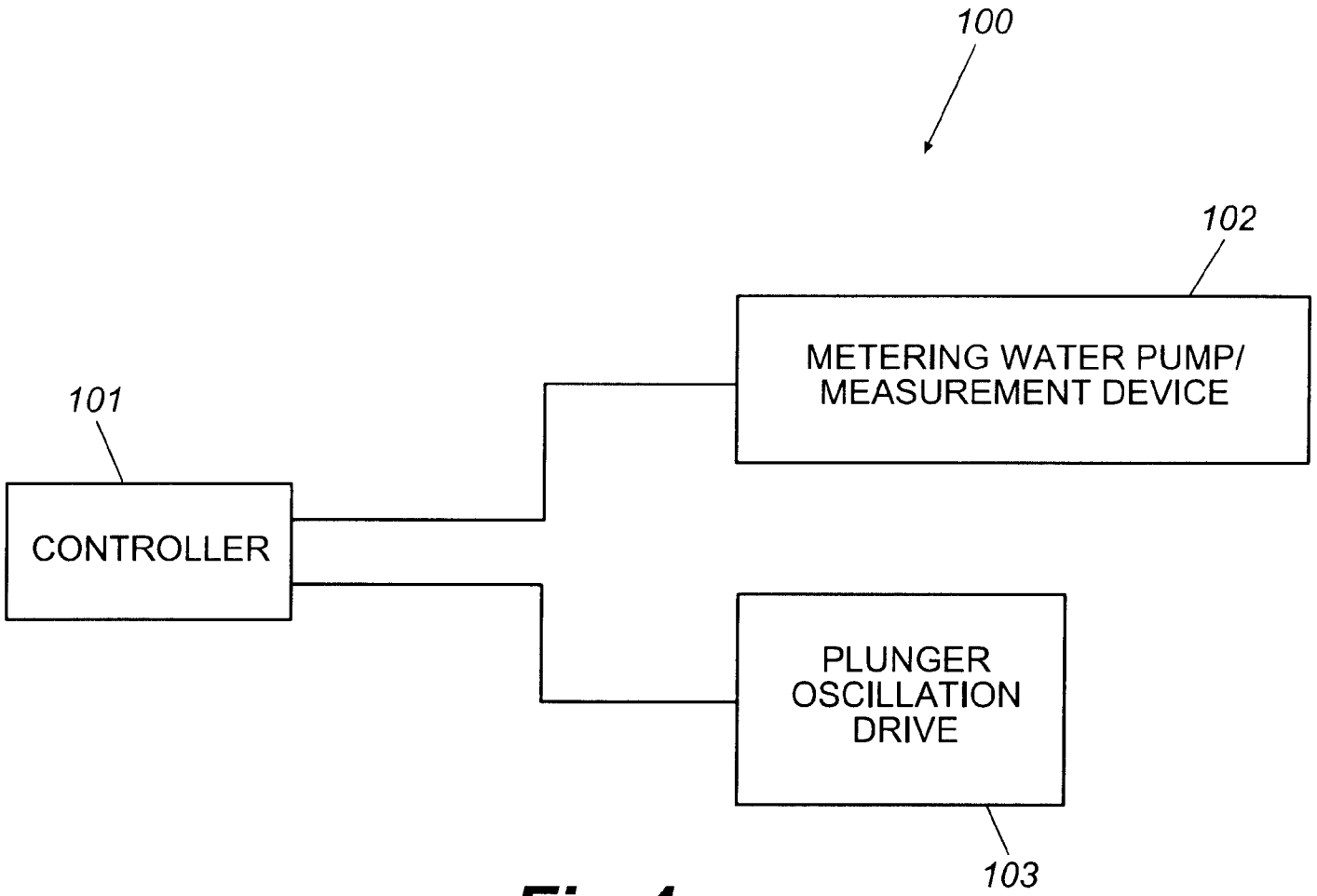
FIG. 4 is a logic flow diagram showing the control of the metering water pump in conjunction with the plunger oscillation drive.

FIG. 4 is a logic flow diagram showing the control of the metering water pump in conjunction with the plunger oscillation drive. FIG. 4 shows a general control configuration 100 including a controller 101 which controls a metering water pump/metering device 102 and a plunger oscillation drive 103. The controller is configured to control the relative speeds of elements 102 and 103.

Materials Used

Parts 12, 70, and 80 are made from a commodity plastic such as HDPE; the seals and check valves such as 30, 40, and 52 can be made from a suitable TPE or elastomer.

Advantages

The above valve assembly includes the following advantages:

1. The pump can be constructed primarily from inexpensive commodity plastics.
2. The single-acting reciprocating pump has a flow pattern that is similar to double-acting reciprocating pumps.
3. Some mixing, of concentrate and water, can be accomplished within the pump body. This allows the nozzle components to be less expensive.
4. The pump readily folds up into the package to facilitate shipping.
5. The pump can be constructed of rigid plastic materials; this makes loading and unloading the package into the dispenser easier.

As noted above, double-acting reciprocating pumps have relatively pulse-free flow because they pump on both the up and down strokes. However, double-acting pumps contain more parts and are more expensive than single-acting pumps. Single-acting pumps do not have a smooth output since they pump in only on direction of the stroke.

The configuration according to the present invention has the cost advantages of a single-acting pump and the smooth-flow advantages of a double-acting pump. In normal, single acting pumps, one gets individual slugs of concentrate in the water stream. Even though this is a single acting piston pump, the flow of concentrate in the mixture appears continuous rather than pulsed. This is because, even on the upstroke, concentrate flows through the valve 40 and into the annular chamber 15 where it is "washed out" by the flow of water.

This pump provides better mixing and customer acceptability. The annular thin flow of concentrate into the water streams provides improved mixing.

Alternatives

By changing the piston and/or rod diameters the amount of concentrate pumped in the up and down strokes can be changed. It is possible to size the diameters so that the outlet flow on the up-stroke equals the outlet flow on the down-stroke.

Conclusion

While this invention has been described in specific detail with reference to the disclosed embodiments, it will be understood that many variations and modifications may be effected within the spirit and scope of the invention as described in the appended claims.

We claim:

1. A pump and dispenser apparatus for mixing a first and a second fluid, said apparatus comprising:

a body, said body defining a first fluid inlet port, a second fluid inlet port, a mixed fluid outlet port, and an interior chamber configured for at least partial mixing of said first and second fluids;

a pump member configured for movement relative to said body, said movement being oscillating linear motion alternating between a first linear direction and a second linear direction, said pump member including a pumping portion configured for said oscillating linear motion at least partially within said interior chamber of said body;

a first one-way valve within said body, said first valve configured to allow fluid flow from said first fluid inlet port to said interior chamber of said body; and a second one-way valve within said pump member, said second valve configured to allow mixing of said first and second fluids within said interior chamber, such that movement of said pump member in said first direction tends to cause flow though said first valve from said inlet port to said interior chamber, and movement of said pump member in said second direction tends to cause mixing of said first and second fluids within said interior chamber.

2. The apparatus of claim 1, wherein said interior chamber of said body is at least partially defined by a cylindrical bore, wherein said pump member is a piston, and wherein said pumping portion is a piston head.

3. The apparatus of claim 1, wherein said first one-way valve is provided by a flexible umbrella valve mounted within said body.

4. The apparatus of claim 1, wherein said second one-way valve is provided by a flexible umbrella valve mounted within said pump member.

5. A pump and dispenser apparatus for mixing a first and a second fluid, said apparatus comprising:

a body, said body defining a first fluid inlet port, a second fluid inlet port, a mixed fluid outlet port, and an interior chamber configured for at least partial mixing of said first and second fluids;

a pump member configured for movement relative to said body, said movement being oscillating linear motion alternating between a first linear direction and a second linear direction, said pump member including a pumping portion configured for said oscillating linear motion at least partially within said interior chamber of said body;

a first one-way valve within said body, said first valve configured to allow fluid flow from said first fluid inlet port to said interior chamber of said body; and a second one-way valve within said pump member, said second valve configured to allow mixing of said first and second fluids within said interior chamber; and a metering pump for metering flow of said second fluid into said second inlet port during said oscillating linear motion of said pump member, such that movement of said pump member in said first direction tends to cause flow though said first valve from said inlet port to said interior chamber, movement of said pump member in said second direction tends to cause mixing of said first and second fluids within said interior chamber, and said metering of said second fluid tends to cause flow out of said outlet port at least during the movement of said pump member in said first linear direction.

6. The apparatus of claim 5, wherein said metering pump is configured to cause flow out of said outlet port during both said first linear direction and a second linear direction of said pump member.

7. The apparatus of claim 6, wherein said interior chamber of said body is at least partially defined by a cylindrical bore, wherein said pump member is a piston, and wherein said pumping portion is a piston head.

8. The apparatus of claim 7, wherein said first one-way valve is provided by a flexible umbrella valve mounted within said body.

9. The apparatus of claim 7, wherein said second one-way valve is provided by a flexible umbrella valve mounted within said pump member.

10. The apparatus of claim 5, wherein said interior chamber of said body is at least partially defined by a cylindrical bore, wherein said pump member is a piston, and wherein said pumping portion is a piston head.

11. A pump and dispenser apparatus for mixing a first and a second fluid, said apparatus comprising:

a body, said body defining a first fluid inlet port, a second fluid inlet port, a mixed fluid outlet port, and an interior chamber configured for at least partial mixing of said first and second fluids prior to their discharge through said mixed fluid outlet port;

a pump member configured for movement relative to said body, said movement being oscillating linear motion alternating between a first linear direction and a second linear direction, said pump member including a pumping portion configured for said oscillating linear motion at least partially within said interior chamber of said body, said pump member separating said interior chamber into two variably-sized chambers, a variably-sized first chamber portion and a variably-sized second chamber portion;

a metering pump for metering flow of said second fluid into said second inlet port and into said second chamber portion during said oscillating linear motion of said pump member;

a first one-way valve within said body, said first valve configured to allow fluid flow from said first fluid inlet port to said first chamber portion; and a second one-way valve within said pump member, said second valve configured to allow flow of said first fluid from said first chamber portion to said second chamber portion, such that mixing of said first and second fluids is provided within said second chamber portion, such that movement of said pump member in said first direction tends to cause flow though said first valve from said inlet port to said first chamber portion, movement of said pump member in said second direction tends to cause mixing of said first and second fluids within said second chamber portion, and said metering of said second fluid tends to cause flow out of said outlet port at least during the movement of said pump member in said first linear direction.

12. The apparatus of claim 11, wherein said metering pump is configured to cause flow out of said outlet port during both said first linear direction and a second linear direction of said pump member.

13. The apparatus of claim 12, wherein said interior chamber of said body is at least partially defined by a cylindrical bore, wherein said pump member is a piston, and wherein said pumping portion is a piston head.

14. The apparatus of claim 11, wherein said interior chamber of said body is at least partially defined by a cylindrical bore, wherein said pump member is a piston, and wherein said pumping portion is a piston head.

15. The apparatus of claim 11, wherein said first one-way valve is provided by a flexible umbrella valve mounted within said body.

16. The apparatus of claim 11, wherein said second one-way valve is provided by a flexible umbrella valve mounted within said pump member.

17. A pump and dispenser apparatus for mixing a first and a second fluid, said apparatus comprising:

a body, said body defining a first fluid inlet port, a second fluid inlet port, a mixed fluid outlet port, and an interior chamber configured for at least partial mixing of said first and second fluids prior to their discharge through said mixed fluid outlet port;

a pump member configured for movement relative to said body, said movement being oscillating linear motion alternating between a first linear direction and a second linear direction, said pump member including a pumping portion configured for said oscillating linear motion at least partially within said interior chamber of said body, said pump member separating said interior chamber into two variably-sized chambers, a variably-sized first chamber portion and a variably-sized second chamber portion;

a metering pump for metering flow of said second fluid into said second inlet port and into said second chamber portion during said oscillating linear motion of said pump member, a first one-way valve within said body, said first valve configured to allow fluid flow from said first fluid inlet port to said first chamber portion; and a second one-way valve within said pump member, said second valve configured to allow flow of said first fluid from said first chamber portion to said second chamber portion, such that mixing of said first and second fluids is provided within said second chamber portion, such that movement of said pump member in said first direction tends to cause enlargement of said first chamber portion and flow though said first valve from said inlet port to said first chamber portion, movement of said pump member in said second direction tends to cause enlargement of said second chamber portion and mixing of said first and second fluids within said second chamber portion, and said metering of said second fluid tends to cause flow out of said outlet port at least during the movement of said pump member in said first linear direction.

18. The apparatus of claim 17, wherein said interior chamber of said body is at least partially defined by a cylindrical bore, wherein said pump member is a piston, and wherein said pumping portion is a piston head.

19. The apparatus of claim 17, wherein said first one-way valve is provided by a flexible umbrella valve mounted within said body.

20. The apparatus of claim 17, wherein said second one-way valve is provided by a flexible umbrella valve mounted within said pump member.

* * * * *